US006793803B2

(12) United States Patent
Reynolds, Jr.

(10) Patent No.: US 6,793,803 B2
(45) Date of Patent: Sep. 21, 2004

(54) DEWAXING PROCESS USING ZEOLITE SSZ-54

(75) Inventor: Richard N. Reynolds, Jr., Point Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 224 days.

(21) Appl. No.: 10/187,136

(22) Filed: Jun. 28, 2002

(65) Prior Publication Data

US 2004/0000505 A1 Jan. 1, 2004

(51) Int. Cl.[7] ..... C10G 73/02; C10G 35/04

(52) U.S. Cl. ..... 208/28; 208/29; 208/30; 208/134; 208/142; 208/143

(58) Field of Search ..... 208/28, 29, 30, 208/134, 142, 143

(56) References Cited

U.S. PATENT DOCUMENTS 6,475,463 B1 * 11/2002 Elomari et al. ..... 423/706
6,676,923 B1 * 1/2004 Zones et al. ..... 423/718

OTHER PUBLICATIONS

U.S. patent application Ser. No. 10/187,883, Zones, not published.
Szostak, Handbook of Molecular Sieves, Van Nostrand Reinhold, 1992, pp. 538–542.

* cited by examiner

*Primary Examiner*—Walter D. Griffin
*Assistant Examiner*—Tam M. Nguyen
(74) *Attorney, Agent, or Firm*—Richard J. Sheridan

(57) ABSTRACT

The present invention relates to the use of crystalline zeolite SSZ-54 as a catalyst in a process for dewaxing hydrocarbon feedstocks.

18 Claims, 4 Drawing Sheets

DEWAXING PROCESS USING ZEOLITE SSZ-54

BACKGROUND OF THE INVENTION

1. Field of the Invention

The present invention relates to processes for dewaxing hydrocarbon feedstocks employing zeolite SSZ-54 as a catalyst.

2. State of the Art

Because of their unique sieving characteristics, as well as their catalytic properties, crystalline molecular sieves and zeolites are especially useful in applications such as hydrocarbon conversion, including dewaxing of hydrocarbon feedstocks. Although many different crystalline molecular sieves have been disclosed, there is a continuing need for new zeolites with desirable properties for hydrocarbon and chemical conversions, and other applications. New zeolites may contain novel internal pore architectures, providing enhanced selectivities in these processes.

SUMMARY OF THE INVENTION

The present invention is directed to the use of a family of crystalline molecular sieves with unique properties, referred to herein as "zeolite SSZ-54" or simply "SSZ-54", in dewaxing processes. Preferably, SSZ-54 is obtained in its silicate, aluminosilicate, titanosilicate, vanadosilicate or borosilicate form. The term "silicate" refers to a zeolite having a high mole ratio of silicon oxide relative to aluminum oxide, preferably a mole ratio greater than 100, including zeolites composed entirely of silicon oxide. As used herein, the term "aluminosilicate" refers to a zeolite containing both alumina and silica and the term "borosilicate" refers to a zeolite containing oxides of both boron and silicon.

In accordance with the present invention, there is provided a dewaxing process comprising contacting a hydrocarbon feedstock under dewaxing conditions with a catalyst comprising a zeolite having a mole ratio greater than about 20 of an oxide selected from silicon oxide, germanium oxide and mixtures thereof to an oxide selected from aluminum oxide, gallium oxide, iron oxide, boron oxide, titanium oxide, indium oxide, vanadium oxide and mixtures thereof and having, after calcination, the X-ray diffraction pattern of FIG. 1 (i.e., SSZ-54), preferably predominantly in the hydrogen form.

The present invention also includes a process for improving the viscosity index of a dewaxed product of waxy hydrocarbon feeds comprising contacting the waxy hydrocarbon feed under isomerization dewaxing conditions with a catalyst comprising SSZ-54, preferably predominantly in the hydrogen form.

The present invention further includes a process for producing a $C_{20+}$ lube oil from a $C_{20+}$ olefin feed comprising isomerizing said olefin feed under isomerization conditions over a catalyst comprising at least one Group VIII metal and SSZ-54. The zeolite may be predominantly in the hydrogen form.

In accordance with this invention, there is also provided a process for catalytically dewaxing a hydrocarbon oil feedstock boiling above about 350° F. and containing straight chain and slightly branched chain hydrocarbons comprising contacting said hydrocarbon oil feedstock in the presence of added hydrogen gas at a hydrogen pressure of about 15-3000 psi with a catalyst comprising at least one Group VIII metal and SSZ-54, preferably predominantly in the hydrogen form. The catalyst may be a layered catalyst comprising a first layer comprising at least one Group VIII metal and SSZ-54, and a second layer comprising an aluminosilicate zeolite which is more shape selective than the SSZ-54 of said first layer.

Also included in the present invention is a process for preparing a lubricating oil which comprises hydrocracking in a hydrocracking zone a hydrocarbonaceous feedstock to obtain an effluent comprising a hydrocracked oil, and catalytically dewaxing said effluent comprising hydrocracked oil at a temperature of at least about 400° F. and at a pressure of from about 15 psig to about 3000 psig in the presence of added hydrogen gas with a catalyst comprising at least one Group VIII metal and SSZ-54. The zeolite may be predominantly in the hydrogen form.

Further included in this invention is a process for isomerization dewaxing a raffinate comprising contacting said raffinate in the presence of added hydrogen with a catalyst comprising at least one Group VIII metal and SSZ-54. The raffinate may be bright stock, and the SSZ-54 may be predominantly in the hydrogen form.

DETAILED DESCRIPTION OF THE INVENTION

The present invention comprises a family of crystalline, medium pore zeolites designated herein "zeolite SSZ-54" or simply "SSZ-54". As used herein, the term "medium pore" means having an average pore size diameter greater than about 4.5–6 Angstroms.

Figure 1:
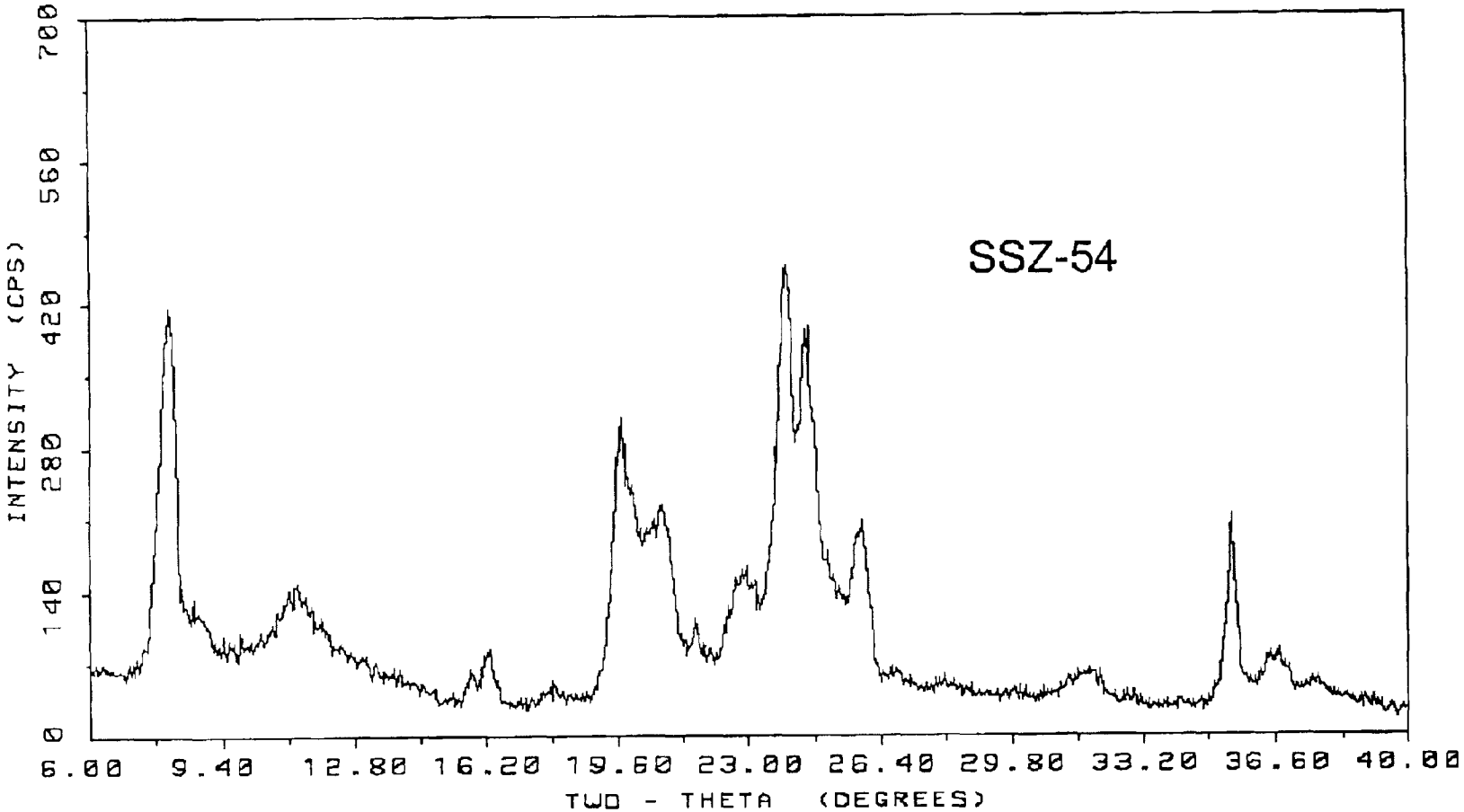
FIG. 1 is an X-ray diffraction pattern of a calcined sample of SSZ-54.
Figure 2:
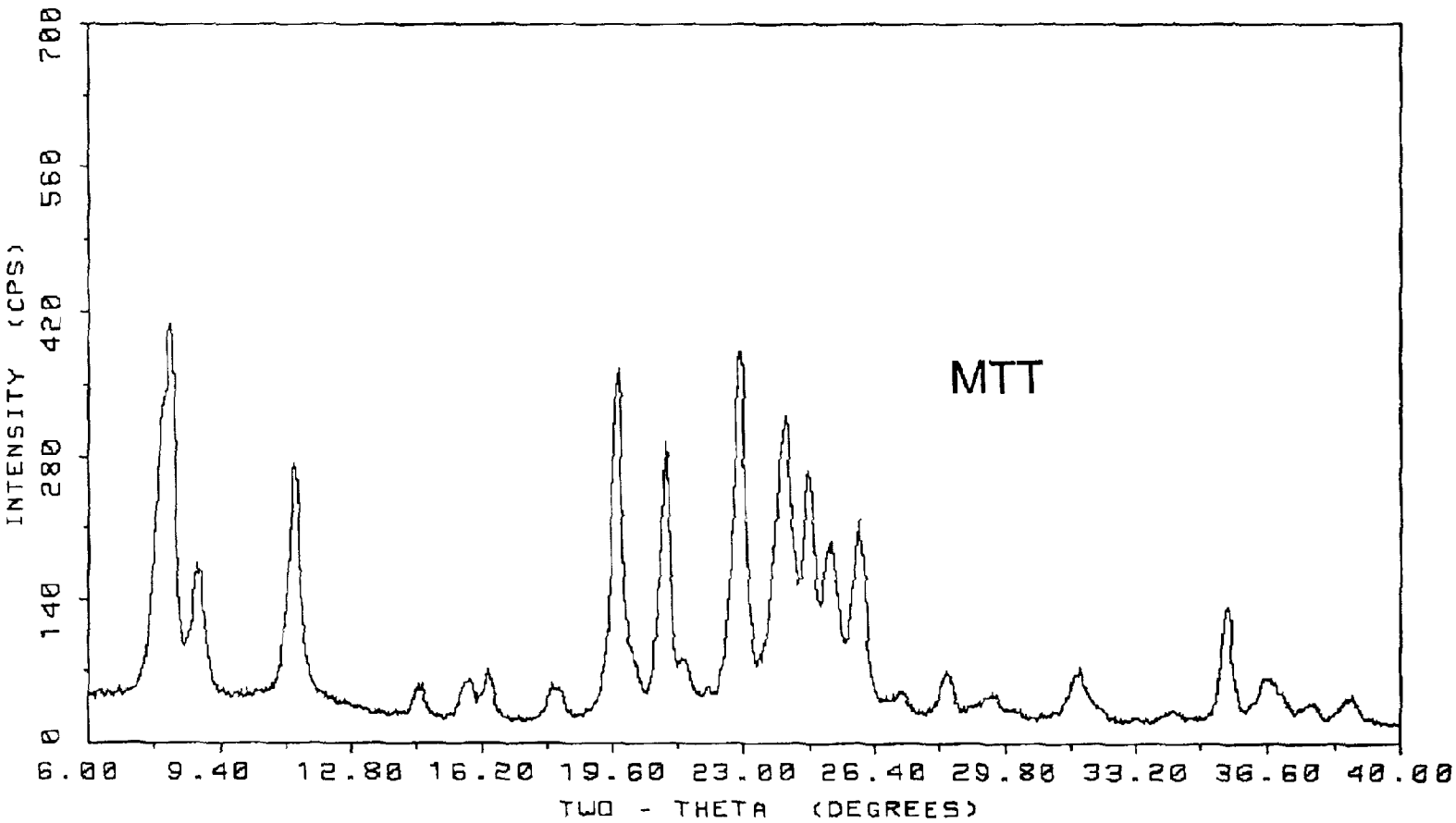
FIG. 2 is an X-ray diffraction pattern of a calcined sample of a zeolite having the MTT crystal structure.
Figure 3:
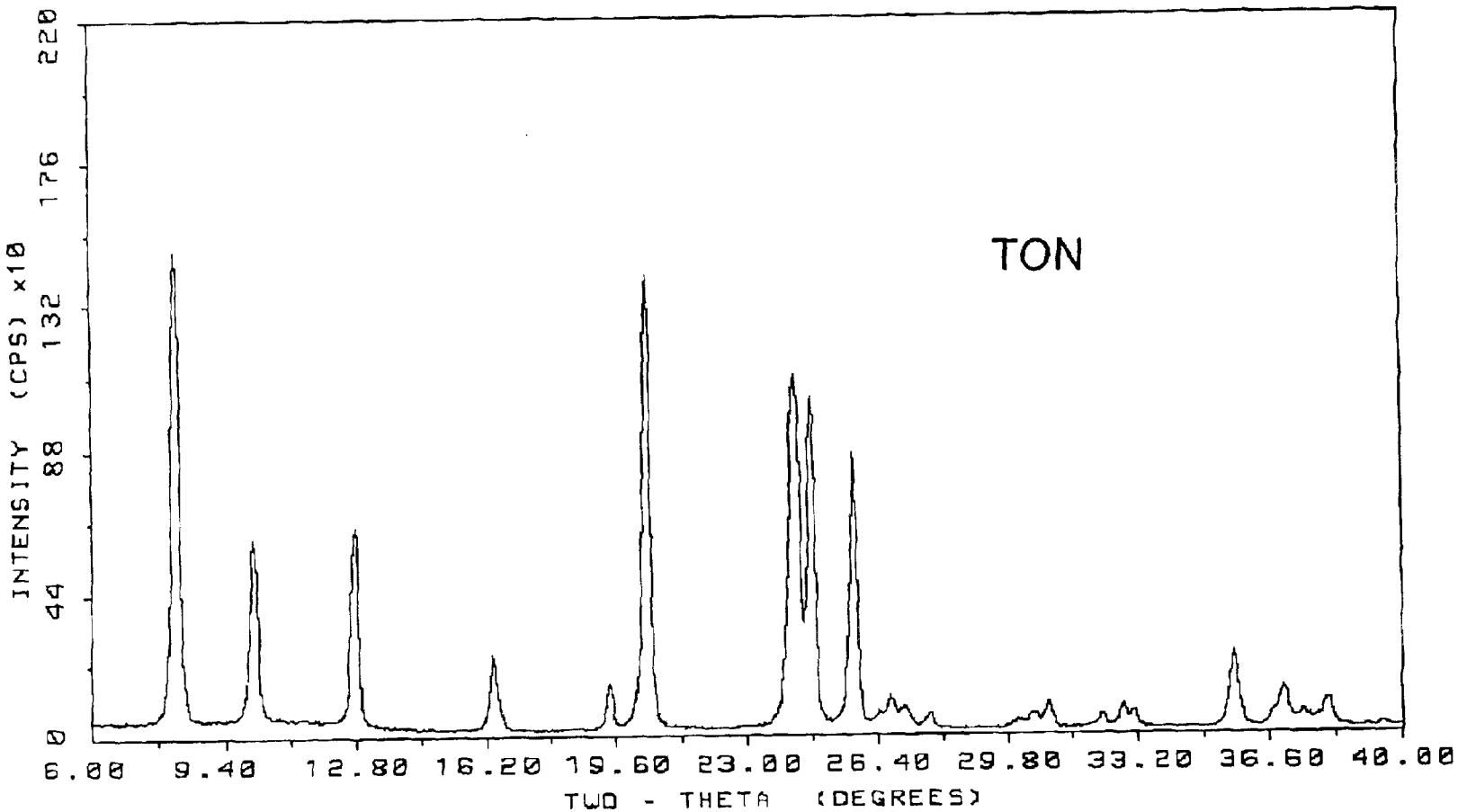
FIG. 3 is an X-ray diffraction pattern of a calcined sample of a zeolite having the TON crystal structure.

While not wishing to be bound by any particular theory, it is believed that SSZ-54 is an intergrowth of the MTT and TON crystal structures FIG. 1 shows the X-ray diffraction diffraction pattern of a calcined sample of SSZ-54. FIG. 2 shows the X-ray diffraction pattern of a calcined sample of a pure phase zeolite having the MTT crystal structure, and FIG. 3 shows the X-ray diffraction pattern of a calcined sample of a pure phase zeolite having the TON crystal structure. It can be seen that there are similarities between the pattern for SSZ-54 and the patterns for MTT and TON.

Figure 4:
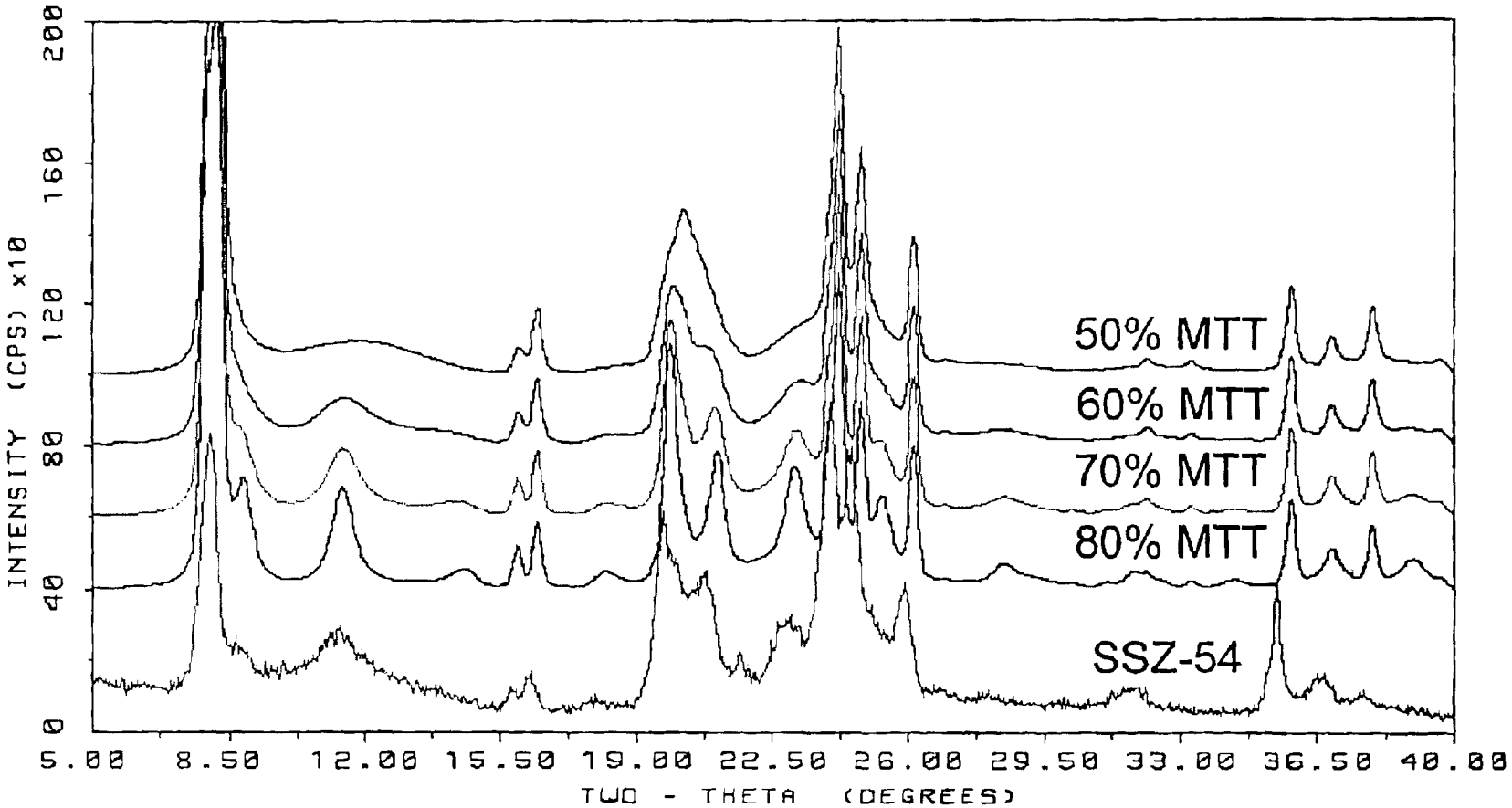
FIG. 4 shows calculated X-ray patterns of calcined zeolites having about 50%, 60%, 70% or 80% MTT crystal structure and the balance the TON crystal structure. For comparison purposes, FIG. 4 also shows the X-ray diffraction pattern for SSZ-54.

FIG. 4 shows calculated X-ray diffraction patterns for zeolites that are an intergrowth of the MTT and TON crystal structures. The calculated patterns are for intergrowths containing about 50%, 60%, 70% and 80% MTT and about 50%, 40%, 30% and 20% TON, respectively. FIG. 4 also shows the X-ray diffraction pattern for SSZ-54. It can be seen that there is a reasonably good correlation between the calculated pattern of 70% MTT/30% TON and the SSZ-54 pattern.

It is further believed that the peak broadening seen in the SSZ-54 pattern of FIG. 4 is due to disorder in the SSZ-54 crystal structure rather than exclusively to small crystal size.

This is further evidence that SSZ-54 is an intergrowth of more than one crystal structure.

When needle-like crystals of SSZ-54 were examined by TEM, the cross-section showed TON and MTT domains within the same crystal. This is further evidence that SSZ-54 is an intergrowth of TON and MTT crystal structures.

After calcination, the SSZ-54 has a crystalline structure whose X-ray powder diffraction pattern includes the characteristic lines shown in Table I below.

TABLE I

| Calcined SSZ-54 | |
|---|---|
| Two Theta (deg.)[a] | Relative Intensity |
| 8.06 | VS |
| 8.78 | W |
| 11.32 | W |
| 15.82 | W |
| 16.28 | W |
| 17.97 | W |
| 19.64 | S–VS |
| 20.68 | VS |
| 22.92 | W–M |
| 24.00 | VS |
| 24.5 | VS |
| 25.94 | M |
| 31.76 | W |
| 35.48 | M |
| 36.62 | W |
| 37.65 | W |

[a]±0.2

[b]The X-ray patterns provided are based on a relative intensity scale in which the strongest line in the X-ray pattern is assigned a value of 100: W(weak) is less than 20; M(medium) is between 20 and 40; S(strong) is between 40 and 60; VS(very strong) is greater than 60.

Table IA below shows the characteristic X-ray powder diffraction lines for calcined SSZ-54 including actual relative intensities.

TABLE IA

| Calcined SSZ-54 | |
|---|---|
| Two Theta (deg.)[a] | Relative Intensity |
| 8.06 | 68 |
| 8.78 | 10 |
| 11.32 | 17 |
| 15.82 | 8 |
| 16.28 | 4 |
| 17.97 | 1 |
| 19.64 | 58 |
| 20.68 | 77 |
| 22.92 | 19 |
| 24.00 | 90 |
| 24.5 | 100 |
| 25.94 | 28 |
| 31.76 | 18 |
| 35.48 | 23 |
| 36.62 | 13 |
| 37.65 | 4 |

In preparing SSZ-54 zeolites, N-isopropyl ethylenediamine, or a mixture of 1-N-isopropyl diethylenetriamine and isobutylamine is used as a crystallization template (sometimes called a structure directing agent). In general, SSZ-54 is prepared by contacting an active source of one or more oxides selected from the group consisting of monovalent element oxides, divalent element oxides, trivalent element oxides, and tetravalent element oxides with the templating agent.

The templating agents of this invention have the following chemical structures:

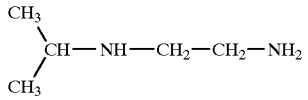

N-isopropyl ethylenediamine

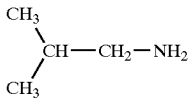

Isobutylamine

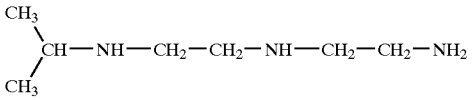

1-N-isopropyl diethylenetriamine

When the templating agent is a mixture of 1-N-isopropyl diethylenetriamine and isobutylamine, the mole ratio of 1-N-isopropyl diethylenetriamine to isobutylamine may be about 1:8.

SSZ-54 is prepared from a reaction mixture having the composition shown in Table A below.

TABLE A

| Reaction Mixture | | |
|---|---|---|
| | Typical | Preferred |
| $YO_2/W_aO_b$ | 25–100 | 30–70 |
| $OH—/YO_2$ | 0.15–0.50 | 0.20–0.30 |
| $Q/YO_2$ | 0.10–1.00 | 0.10–0.40 |
| $M_{2/n}/YO_2$ | 0.03–0.20 | 0.05–0.15 |
| $H_2O/YO_2$ | 10–75 | 15–40 |

where Y, W, Q, M and n are as defined above, and a is 1 or 2, and b is 2 when a is 1 (i.e., W is tetravalent) and b is 3 when a is 2 (i.e., W is trivalent).

In practice, SSZ-54 is prepared by a process comprising:

(a) preparing an aqueous solution containing sources of at least one oxide capable of forming a crystalline molecular sieve and the templating agent of this invention;

(b) maintaining the aqueous solution under conditions sufficient to form crystals of SSZ-54; and (c) recovering the crystals of SSZ-54.

Accordingly, SSZ-54 may comprise the crystalline material and the templating agent in combination with metallic and non-metallic oxides bonded in tetrahedral coordination through shared oxygen atoms to form a cross-linked three dimensional crystal structure. The metallic and non-metallic oxides comprise one or a combination of oxides of a first tetravalent element(s), and one or a combination of a second tetravalent element(s) different from the first tetravalent element(s), trivalent element(s), pentavalent element(s) or mixture thereof. The first tetravalent element(s) is preferably selected from the group consisting of silicon, germanium and combinations thereof. More preferably, the first tetravalent element is silicon. The second tetravalent element (which is different from the first tetravalent element), trivalent element and pentavalent element is preferably selected from the group consisting of aluminum, gallium, iron, boron, titanium, indium, vanadium and combinations thereof. More preferably, the second trivalent or tetravalent element is aluminum or boron.

Typical sources of aluminum oxide for the reaction mixture include aluminates, alumina, aluminum colloids, aluminum oxide coated on silica sol, hydrated alumina gels such as $Al(OH)_3$ and aluminum compounds such as $AlCl_3$ and $Al_2(SO_4)_3$. Typical sources of silicon oxide include silicates, silica hydrogel, silicic acid, fumed silica, colloidal silica, tetra-alkyl orthosilicates, and silica hydroxides. Boron, as well as gallium, germanium, titanium, indium, vanadium and iron, can be added in forms corresponding to their aluminum and silicon counterparts.

A source zeolite reagent may provide a source of aluminum or boron. In most cases, the source zeolite also provides a source of silica. The source zeolite in its dealuminated or deboronated form may also be used as a source of silica, with additional silicon added using, for example, the conventional sources listed above. Use of a source zeolite reagent as a source of alumina for the present process is more completely described in U.S. Pat. No. 5,225,179, issued Jul. 6, 1993 to Nakagawa entitled "Method of Making Molecular Sieves", the disclosure of which is incorporated herein by reference.

Typically, an alkali metal hydroxide and/or an alkaline earth metal hydroxide, such as the hydroxide of sodium, potassium, lithium, cesium, rubidium, calcium, and magnesium, is used in the reaction mixture; however, this component can be omitted so long as the equivalent basicity is maintained. The templating agent may be used to provide hydroxide ion. Thus, it may be beneficial to ion exchange, for example, the halide for hydroxide ion, thereby reducing or eliminating the alkali metal hydroxide quantity required. The alkali metal cation or alkaline earth cation may be part of the as-synthesized crystalline oxide material, in order to balance valence electron charges therein.

The reaction mixture is maintained at an elevated temperature until the crystals of the SSZ-54 zeolite are formed. The hydrothermal crystallization is usually conducted under autogenous pressure, at a temperature between 100° C. and 200° C., preferably between 135° C. and 160° C. The crystallization period is typically greater than 1 day and preferably from about 3 days to about 20 days.

Preferably, the zeolite is prepared using mild stirring or agitation.

During the hydrothermal crystallization step, the SSZ-54 crystals can be allowed to nucleate spontaneously from the reaction mixture. The use of SSZ-54 crystals as seed material can be advantageous in decreasing the time necessary for complete crystallization to occur. In addition, seeding can lead to an increased purity of the product obtained by promoting the nucleation and/or formation of SSZ-54 over any undesired phases. When used as seeds, SSZ-54 crystals are added in an amount between 0.1 and 10% of the weight of silica used in the reaction mixture.

Once the zeolite crystals have formed, the solid product is separated from the reaction mixture by standard mechanical separation techniques such as filtration. The crystals are water-washed and then dried, e.g., at 90° C. to 150° C. for from 8 to 24 hours, to obtain the as-synthesized SSZ-54 zeolite crystals. The drying step can be performed at atmospheric pressure or under vacuum.

SSZ-54 as prepared has a mole ratio of an oxide selected from silicon oxide, germanium oxide and mixtures thereof to an oxide selected from aluminum oxide, gallium oxide, iron oxide, boron oxide, titanium oxide, indium oxide, vanadium oxide and mixtures thereof greater than about 20; and has, after calcination, the X-ray diffraction pattern of FIG. 1. SSZ-54 further has a composition, as synthesized (i.e., prior to removal of the templating agent from the zeolite) and in the anhydrous state, in terms of mole ratios, shown in Table B below.

TABLE B

| As-Synthesized SSZ-54 | |
|---|---|
| $YO_2/W_cO_d$ | 25–100 |
| $M_{2/n}/YO_2$ | 0.02–0.06 |
| $Q/YO_2$ | 0.01–0.04 |

where Y, W, c, d, M, n and Q are as defined above.

SSZ-54 can be made essentially aluminum free, i.e., having a silica to alumina mole ratio of ∞. A method of increasing the mole ratio of silica to alumina is by using standard acid leaching or chelating treatments. However, essentially aluminum-free SSZ-54 can be synthesized directly using essentially aluminum-free silicon sources as the main tetrahedral metal oxide component, if boron is also present. SSZ-54 can also be prepared directly as either an aluminosilicate or a borosilicate.

Lower silica to alumina ratios may also be obtained by using methods which insert aluminum into the crystalline framework. For example, aluminum insertion may occur by thermal treatment of the zeolite in combination with an alumina binder or dissolved source of alumina. Such procedures are described in U.S. Pat. No. 4,559,315, issued on Dec. 17, 1985 to Chang et al.

It is believed that SSZ-54 is comprised of a new framework structure or topology which is characterized by its X-ray diffraction pattern. After calcination, the SSZ-54 zeolites have a crystalline structure whose X-ray powder diffraction pattern exhibits the characteristic lines of FIG. 1.

The X-ray powder diffraction patterns were determined by standard techniques. The radiation was the K-alpha/doublet of copper.

Minor variations in the diffraction pattern can result from variations in the silica-to-alumina or silica-to-boron mole ratio of the particular sample due to changes in lattice constants. In addition, sufficiently small crystals will affect the shape and intensity of peaks, leading to significant peak broadening.

Representative peaks from the X-ray diffraction pattern of calcined SSZ-54 are shown in FIG. 1. Calcination can also result in changes in the intensities of the peaks as compared to patterns of the "as-made" material, as well as minor shifts in the diffraction pattern. The zeolite produced by exchanging the metal or other cations present in the zeolite with various other cations (such as $H^+$ or $NH_4^+$) yields essentially the same diffraction pattern, although again, there may be minor shifts in the interplanar spacing and variations in the relative intensities of the peaks. Notwithstanding these minor perturbations, the basic crystal lattice remains unchanged by these treatments.

Crystalline SSZ-54 can be used as-synthesized, but preferably will be thermally treated (calcined). Usually, it is desirable to remove the alkali metal cation by ion exchange and replace it with hydrogen, ammonium, or any desired metal ion. The zeolite can be leached with chelating agents, e.g., EDTA or dilute acid solutions, to increase the silica to alumina mole ratio. The zeolite can also be steamed; steaming helps stabilize the crystalline lattice to attack from acids.

The zeolite can be used in intimate combination with hydrogenating components, such as tungsten, vanadium, molybdenum, rhenium, nickel, cobalt, chromium, manganese or a noble metal, such as palladium or platinum, for those applications in which a hydrogenation-dehydrogenation function is desired.

Metals may also be introduced into the zeolite by replacing some of the cations in the zeolite with metal cations via standard ion exchange techniques (see, for example, U.S. Pat. No. 3,140,249 issued Jul. 7, 1964 to Plank et al.; U.S. Pat. No. 3,140,251 issued Jul. 7, 1964 to Plank et al.; and U.S. Pat. No. 3,140,253 issued Jul. 7, 1964 to Plank et al.). Typical replacing cations can include metal cations, e.g., rare earth, Group IA, Group IIA and Group VIII metals, as well as their mixtures. Of the replacing metallic cations, cations of metals such as rare earth, Mn, Ca, Mg, Zn, Cd, Pt, Pd, Ni, Co, Ti, Al, Sn and Fe are particularly preferred.

The hydrogen, ammonium and metal components can be ion-exchanged into the SSZ-54. The zeolite can also be impregnated with the metals, or the metals can be physically and intimately admixed with the zeolite using standard methods known to the art.

Typical ion-exchange techniques involve contacting the zeolite with a solution containing a salt of the desired replacing cation or cations. Although a wide variety of salts can be employed, chlorides and other halides, acetates, nitrates and sulfates are particularly preferred. The zeolite is usually calcined prior to the ion-exchange procedure to remove the organic matter in the channels and on the surface, since this results in a more effective ion exchange. Representative ion exchange techniques are disclosed in a wide variety of patents including U.S. Pat. No. 3,140,249 issued Jul. 7, 1964 to Plank et al.; U.S. Pat. No. 3,140,251 issued Jul. 7, 1964 to Plank et al. and U.S. Pat. No. 3,140,253 issued on Jul. 7, 1964 to Plank et al.

Following contact with the salt solution of the desired replacing cation, the zeolite is typically washed with water and dried at temperatures ranging from 65° C. to about 200° C. After washing, the zeolite can be calcined in air or inert gas at temperatures ranging from about 200° C. to about 800° C. for periods of time ranging from 1 to 48 hours, or more, to produce a catalytically active product especially useful in hydrocarbon conversion processes.

Regardless of the cations present in the synthesized form of SSZ-54, the special arrangement of the atoms which form the basic crystal lattice of the zeolite remains essentially unchanged.

SSZ-54 can be formed into a wide variety of physical shapes. Generally speaking, the zeolite can be in the form of a powder, a granule or a molded product, such as extrudate having a particle size sufficient to pass through a 2-mesh (Tyler) screen and be retained on a 400-mesh (Tyler) screen. In cases where the catalyst is molded, such as by extrusion with an organic binder, the zeolite can be extruded before drying, or dried or partially dried and then extruded.

SSZ-54 can be composited with other materials resistant to the temperatures and other conditions employed in organic conversion processes. Such matrix materials include active and inactive materials and synthetic or naturally occurring zeolites as well as inorganic materials such as clays, silica and metal oxides. Examples of such materials and the manner in which they can be used are disclosed in U.S. Pat. No. 4,910,006, issued May 20, 1990 to Zones et al. and U.S. Pat. No. 5,316,753, issued May 31, 1994 to Nakagawa, both of which are incorporated by reference herein in their entirety.

SSZ-54 zeolites can be used in dewaxing hydrocarbonaceous feedstocks. Hydrocarbonaceous feedstocks contain carbon compounds and can be from many different sources, such as virgin petroleum fractions, recycle petroleum fractions, shale oil, liquefied coal, tar sand oil, synthetic paraffins from NAO, recycled plastic feedstocks and, in general, can be any carbon containing feedstock susceptible to zeolitic catalytic dewaxing reactions. Depending on the type of processing the hydrocarbonaceous feed is to undergo, the feed can contain metal or be free of metals, it can also have high or low nitrogen or sulfur impurities. It can be appreciated, however, that in general processing will be more efficient (and the catalyst more active) the lower the metal, nitrogen, and sulfur content of the feedstock.

The dewaxing of hydrocarbonaceous feeds can take place in any convenient mode, for example, in fluidized bed, moving bed, or fixed bed reactors depending on the types of process desired. The formulation of the catalyst particles will vary depending on the conversion process and method of operation.

Typical dewaxing reaction conditions which may be employed when using catalysts comprising SSZ-54 in the dewaxing reactions of this invention include a temperature of about 200–475° C., preferably about 250–450° C., a pressure of about 15–3000 psig, preferably about 200–3000 psig, and a LHSV of about 0.1–20, preferably 0.2–10.

SSZ-54, preferably predominantly in the hydrogen form, can be used to dewax hydrocarbonaceous feeds by selectively removing straight chain paraffins. Typically, the viscosity index of the dewaxed product is improved (compared to the waxy feed) when the waxy feed is contacted with SSZ-54 under isomerization dewaxing conditions.

The catalytic dewaxing conditions are dependent in large measure on the feed used and upon the desired pour point. Hydrogen is preferably present in the reaction zone during the catalytic dewaxing process. The hydrogen to feed ratio is typically between about 500 and about 30,000 SCF/bbl (standard cubic feet per barrel), preferably about 1000 to about 20,000 SCF/bbl. Generally, hydrogen will be separated from the product and recycled to the reaction zone. Typical feedstocks include light gas oil, heavy gas oils and reduced crudes boiling above about 350° F.

A typical dewaxing process is the catalytic dewaxing of a hydrocarbon oil feedstock boiling above about 350° F. and containing straight chain and slightly branched chain hydrocarbons by contacting the hydrocarbon oil feedstock in the presence of added hydrogen gas at a hydrogen pressure of about 15–3000 psi with a catalyst comprising SSZ-54 and at least one Group VIII metal.

The SSZ-54 hydrodewaxing catalyst may optionally contain a hydrogenation component of the type commonly employed in dewaxing catalysts. See the aforementioned U.S. Pat. Nos. 4,910,006 and 5,316,753 for examples of these hydrogenation components.

The hydrogenation component is present in an effective amount to provide an effective hydrodewaxing and hydroisomerization catalyst preferably in the range of from about 0.05 to 5% by weight. The catalyst may be run in such a mode to increase isodewaxing at the expense of cracking reactions.

The feed may be hydrocracked, followed by dewaxing. This type of two stage process and typical hydrocracking conditions are described in U.S. Pat. No. 4,921,594, issued May 1, 1990 to Miller, which is incorporated herein by reference in its entirety.

SSZ-54 may also be utilized as a dewaxing catalyst in the form of a layered catalyst. That is, the catalyst comprises a first layer comprising zeolite SSZ-54 and at least one Group VIII metal, and a second layer comprising an aluminosilicate zeolite which is more shape selective than zeolite SSZ-54. The use of layered catalysts is disclosed in U.S. Pat. No. 5,149,421, issued Sep. 22, 1992 to Miller, which is incorporated by reference herein in its entirety. The layering may also include a bed of SSZ-54 layered with a non-zeolitic component designed for either hydrocracking or hydrofinishing.

SSZ-54 may also be used to dewax raffinates, including bright stock, under conditions such as those disclosed in U. S. Pat. No. 4,181,598, issued Jan. 1, 1980 to Gillespie et al., which is incorporated by reference herein in its entirety.

It is often desirable to use mild hydrogenation (sometimes referred to as hydrofinishing) to produce more stable dewaxed products. The hydrofinishing step can be performed either before or after the dewaxing step, and preferably after. Hydrofinishing is typically conducted at temperatures ranging from about 190° C. to about 340° C. at pressures from about 400 psig to about 3000 psig at space velocities (LHSV) between about 0.1 and 20 and a hydrogen recycle rate of about 400 to 1500 SCF/bbl. The hydrogenation catalyst employed must be active enough not only to hydrogenate the olefins, diolefins and color bodies which may be present, but also to reduce the aromatic content. Suitable hydrogenation catalyst are disclosed in U.S. Pat. No. 4,921,594, issued May 1, 1990 to Miller, which is incorporated by reference herein in its entirety. The hydrofinishing step is beneficial in preparing an acceptably stable product (e.g., a lubricating oil) since dewaxed products prepared from hydrocracked stocks tend to be unstable to air and light and tend to form sludges spontaneously and quickly.

Lube oil may be prepared using SSZ-54. For example, a $C_{20+}$ lube oil may be made by isomerizing a $C_{20+}$ olefin feed over a catalyst comprising SSZ-54 in the hydrogen form and at least one Group VIII metal. Alternatively, the lubricating oil may be made by hydrocracking in a hydrocracking zone a hydrocarbonaceous feedstock to obtain an effluent comprising a hydrocracked oil, and catalytically dewaxing the effluent at a temperature of at least about 400° F. and at a pressure of from about 15 psig to about 3000 psig in the presence of added hydrogen gas with a catalyst comprising SSZ-54 in the hydrogen form and at least one Group VIII metal.

EXAMPLES

The following examples demonstrate but do not limit the present invention.

Example 1

Preparation of SSZ-54

Into the Teflon cup of a Parr 23 ml reactor is placed 2 ml of a 1N KOH solution, 4 grams of water and 0.30 grams of N-isopropyl ethylenediamine. The resulting mixture is mixed by hand. 1.27 Grams of Ludox AS-30 colloidal silica (30% $SiO_2$) is added and then 0.90 gram of Nalco 1056 colloidal silica particles coated with $Al_2O_3$ is added last. The resulting reaction mixture has a silica/alumina mole ratio ("SAR") of 30. The reactor is sealed and heated at 170° C. with 43 RPM tumbling for four weeks. Analysis by XRD shows the product to be SSZ-54.

Example 2

Preparation of SSZ-54

A reaction is carried out as described in Example 1 except that the SAR is adjusted to 40 by using 1.47 grams Ludox AS-30 colloidal silica and 0.62 gram Nalco 1056 colloidal silica. A product is produced after two weeks and identified by XRD as SSZ-54.

Example 3

Preparation of SSZ-54

A reaction is carried out as described in Example 1 except that the SAR is adjusted to 50 by using 1.57 grams Ludox AS-30 colloidal silica and 0.52 gram Nalco 1056 colloidal silica. A product is produced after three weeks and identified by XRD as mostly SSZ-54 with a minor amount of cristobalite.

Example 4

Preparation of SSZ-54

0.088 Gram of Reheis F-200 dried aluminum hydroxide gel (50–53 wt. % $Al_2O_3$) is dissolved in 3 ml of a 1N KOH solution, 8.4 grams water and 0.40 gram N-isopropyl ethylenediamine. 0.90 Gram of Cabosil M5 filmed silica is blended into the resulting reaction mixture and the reactor is closed, sealed and heated at 170° C. with 45 RPM tumbling. At nine days of run time, the reaction mixture is cooled and the product is collected and washed. XRD analysis shows the product to be SSZ-54. The product had a SAR of 36.

Example 5

Preparation of SSZ-54

In the Teflon cup of a Parr 23 ml reactor, 3 grams of 1 N KOH solution, 5 grams of water and 1.90 grams of Ludox AS-30 colloidal silica are mixed. Then 0.07 gram (0.5 millimole) of 1-N-isopropyldiethylenetriamine is added to the cup. Next, 1.30 grams of Nalco 1056 colloidal silica (26 wt. % silica coated with 4 wt. % alumina) is added with spatula stirring. 0.22 Grams of isobutylamine is added and the reactor is closed and heated at 170° C. with 43 rpm tumbling. After six days, a sample is taken for scanning electron microscopy. A crystalline material is recovered and found by XRD to be SSZ-54.

Examples 6–9

Reactions are run in a manner similar to that described in Example 1 using the reagents shown in the table below. Amounts of reagents are in grams; the seeds are previously made SSZ-54. The product of each reaction is also shown in the table.

| Ex. No. | 1N KOH | Reheis F-2000 | Q[a] | Nyacol[b] | $H_2O$ | Seeds | Rxn. mix. SAR | Product |
|---|---|---|---|---|---|---|---|---|
| 6 | 3.0 | 0.10 | 0.40 | 2.25 | 5.0 | 0.05 | 30 | SSZ-54 |
| 7 | 3.0 | 0.08 | 0.40 | 2.25 | 5.0 | 0.05 | 37 | SSZ-54 |
| 8 | 3.0 | 0.06 | 0.40 | 2.25 | 5.0 | 0.05 | 50 | SSZ-54 |
| 9 | 3.0 | 0.02 | 0.40 | 2.25 | 5.0 | 0.05 | 150 | Cristobalite + Minor SSZ-54 |

[a]N-isopropyl ethylenediamine
[b]colloidal silica (40% $SiO_2$)

Example 10

Calcination of SSZ-54

The material from Example 1 is calcined in the following manner. A thin bed of material is heated in a muffle furnace from room temperature to 120° C. at a rate of 1° C. per minute and held at 120° C. for three hours. The temperature is then ramped up to 540° C. at the same rate and held at this temperature for 5 hours, after which it is increased to 594° C. and held there for another 5 hours. A 50/50 mixture of air and nitrogen is passed over the zeolite at a rate of 20 standard cubic feet per minute during heating.

Example 11

$NH_4$ Exchange

Ion exchange of calcined SSZ-54 material (prepared in Example 10) is performed using $NH_4NO_3$ to convert the zeolite from its $Na^+$ form to the $NH_4^+$ form, and, ultimately, the $H^+$ form. Typically, the same mass of $NH_4NO_3$ as zeolite is slurried in water at a ratio of 25-50:1 water to zeolite. The exchange solution is heated at 95° C. for 2 hours and then filtered. This procedure can be repeated up to three times. Following the final exchange, the zeolite is washed several times with water and dried. This $NH_4^+$ form of SSZ-54 can then be converted to the $H^+$ form by calcination (as described in Example 9) to 540° C.

Example 12

Constraint Index Determination

The hydrogen form of the zeolite of Example 11 is pelletized at 2–3 KPSI, crushed and meshed to 20–40, and then >0.50 gram is calcined at about 540° C. in air for four hours and cooled in a desiccator. 0.50 Gram is packed into a ⅜ inch stainless steel tube with alundum on both sides of the zeolite bed. A Lindburg furnace is used to heat the reactor tube. Helium is introduced into the reactor tube at 10 cc/min. and at atmospheric pressure. The reactor is heated to about 800° F., and a 50/50 (w/w) feed of n-hexane and 3-methylpentane is introduced into the reactor at a rate of 8 μl/min. Feed delivery is made via a Brownlee pump. Direct sampling into a gas chromatograph begins after 10 minutes of feed introduction. The Constraint Index value is calculated from the gas chromatographic data using methods known in the art, and is found to be 21. At 800° F. and 40 minutes on-stream, feed conversion was 40%.

Example 13

Dewaxing with SSZ-54

A hydrocarbon feedstock is dewaxed using SSZ-54 (20-40 mesh) containing 1.42 wt. % Pt. The feedstock has an API gravity of 28.3 (60° C.), nitrogen content of 2.9 mg/μl, sulfur content of 39 ppm, pour point of +45° C. and a viscosity of 28.75 cSt at 70° C. The reaction is run at a $WHSV^{-1}$ of 2.18, pressure of 2300 psi, hydrogen feed rate of 5000 SCFB and a temperature of 650° F. The dewaxed product is then hydrofinished using a hydrofinishing catalyst containing 0.6 wt. % Pd and 0.3 wt. % Pt at 450° F., 2206 psi and 1.81 $WHSV^{-1}$. The data from the reaction is shown in the table below.

| | |
|---|---|
| Hours on stream | 263 |
| Temperature | 650° F. |
| Titration | Yes |
| Pour point | −15° C. |
| Lube yield | 92.6% |
| Cloud point | −4° C. |
| Viscosity index | 93 |

What is claimed is:

1. A dewaxing process comprising contacting a hydrocarbon feedstock under dewaxing conditions with a catalyst comprising a zeolite having a mole ratio greater than about 20 of an oxide selected from silicon oxide, germanium oxide and mixtures thereof to an oxide selected from aluminum oxide, gallium oxide, iron oxide, boron oxide, titanium oxide, indium oxide, vanadium oxide and mixtures thereof and having, after calcination, the X-ray diffraction pattern of FIG. 1.

2. The process of claim 1 wherein the zeolite is predominantly in the hydrogen form.

3. A process for improving the viscosity index of a dewaxed product of waxy hydrocarbon feeds comprising contacting a waxy hydrocarbon feed under isomerization dewaxing conditions with a catalyst comprising a zeolite having a mole ratio greater than about 20 of an oxide selected from silicon oxide, germanium oxide and mixtures thereof to an oxide selected from aluminum oxide, gallium oxide, iron oxide, boron oxide, titanium oxide, indium oxide, vanadium oxide and mixtures thereof and having, after calcination, the X-ray diffraction pattern of FIG. 1.

4. The process of claim 3 wherein the zeolite is predominantly in the hydrogen form.

5. A process for producing a $C_{20+}$ lube oil from a $C_{20+}$ olefin feed comprising isomerizing said olefin feed under isomerization conditions over a catalyst comprising a zeolite having a mole ratio greater than about 20 of an oxide selected from silicon oxide, germanium oxide and mixtures thereof to an oxide selected from aluminum oxide, gallium oxide, iron oxide, boron oxide, titanium oxide, indium oxide, vanadium oxide and mixtures thereof and having, after calcination, the X-ray diffraction pattern of FIG. 1.

6. The process of claim 5 wherein the zeolite is predominantly in the hydrogen form.

7. The process of claim 5 wherein the catalyst further comprises at least one Group VIII metal.

8. A process for catalytically dewaxing a hydrocarbon oil feedstock boiling above about 350° F. and containing straight chain and slightly branched chain hydrocarbons comprising contacting said hydrocarbon oil feedstock in the presence of added hydrogen gas at a hydrogen pressure of about 15–3000 psi under dewaxing conditions with a catalyst comprising a zeolite having a mole ratio greater than about 20 of an oxide selected from silicon oxide, germanium oxide and mixtures thereof to an oxide selected from aluminum oxide, gallium oxide, iron oxide, boron oxide, titanium oxide, indium oxide, vanadium oxide and mixtures thereof and having, after calcination, the X-ray diffraction pattern of FIG. 1.

9. The process of claim 8 wherein the zeolite is predominantly in the hydrogen form.

10. The process of claim 8 wherein the catalyst further comprises at least one Group VIII metal.

11. The process of claim 8 wherein said catalyst comprises a layered catalyst comprising a first layer comprising the zeolite and at least one Group VIII metal, and a second layer comprising an aluminosilicate zeolite which is more shape selective than the zeolite of said first layer.

12. A process for preparing a lubricating oil which comprises:

hydrocracking in a hydrocracking zone a hydrocarbonaceous feedstock to obtain an effluent comprising a hydrocracked oil; and catalytically dewaxing said effluent comprising hydrocracked oil at a temperature of at least about 400° F. and at a pressure of from about 15 psig to about 3000 psig in the presence of added hydrogen gas with a catalyst comprising a zeolite having a mole ratio greater than about 20 of an oxide selected from silicon oxide, germanium oxide and mixtures thereof to an oxide selected from aluminum oxide, gallium oxide, iron oxide, boron oxide, titanium oxide, indium oxide, vanadium oxide and mixtures thereof and having, after calcination, the X-ray diffraction pattern of FIG. 1.

13. The process of claim 12 wherein the zeolite is predominantly in the hydrogen form.

14. The process of claim 13 wherein the catalyst further comprises at least one Group VIII metal.

15. A process for isomerization dewaxing a raffinate comprising contacting said raffinate in the presence of added hydrogen under isomerization dewaxing conditions with a catalyst comprising a zeolite having a mole ratio greater than about 20 of an oxide selected from silicon oxide, germanium oxide and mixtures thereof to an oxide selected from aluminum oxide, gallium oxide, iron oxide, boron oxide, titanium oxide, indium oxide, vanadium oxide and mixtures thereof and having, after calcination, the X-ray diffraction pattern of FIG. 1.

16. The process of claim 15 wherein the zeolite is predominantly in the hydrogen form.

17. The process of claim 15 wherein the catalyst further comprises at least one Group VIII metal.

18. The process of claim 15 wherein the raffinate is bright stock.

* * * * *